US009117443B2

(12) United States Patent
Walsh

(10) Patent No.: US 9,117,443 B2
(45) Date of Patent: Aug. 25, 2015

(54) WEARING STATE BASED DEVICE OPERATION

(75) Inventor: Scott Walsh, Foxham (GB)

(73) Assignee: Plantronics, Inc., Santa Cruz, CA (US)

( * ) Notice: Subject to any disclaimer, the term of this patent is extended or adjusted under 35 U.S.C. 154(b) by 610 days.

(21) Appl. No.: 13/416,362

(22) Filed: Mar. 9, 2012

(65) Prior Publication Data

US 2013/0238340 A1 Sep. 12, 2013

(51) Int. Cl.

| | |
|---|---|
| ***G10L 13/08*** | (2013.01) |
| ***G10L 13/04*** | (2013.01) |
| ***H04R 1/10*** | (2006.01) |
| *H04R 3/12* | (2006.01) |

(52) U.S. Cl.

CPC ..... *G10L 13/04* (2013.01); *H04R 1/1041* (2013.01); *H04R 3/12* (2013.01); *H04R 2201/107* (2013.01); *H04R 2420/03* (2013.01)

(58) Field of Classification Search

CPC ..... G10L 13/00; G10L 13/02; G10L 13/04; G10L 13/043; G10L 2013/00; G10L 2013/02; G10L 2013/08

USPC ..... 704/260, 258, 266.27, 271, 278

See application file for complete search history.

(56) References Cited

U.S. PATENT DOCUMENTS

| | | | | |
|---|---|---|---|---|
| 2002/0094067 | A1 * | 7/2002 | August | 379/88.01 |
| 2004/0133459 | A1 * | 7/2004 | Oliver et al. | 705/9 |
| 2007/0076897 | A1 | 4/2007 | Philipp | |
| 2008/0112567 | A1 | 5/2008 | Siegel et al. | |
| 2008/0260169 | A1 * | 10/2008 | Reuss | 381/58 |

FOREIGN PATENT DOCUMENTS

| | | | |
|---|---|---|---|
| WO | 0163888 | A | 8/2001 |

* cited by examiner

*Primary Examiner* — Qi Han

(74) *Attorney, Agent, or Firm* — Chuang Intellectual Property Law

(57) ABSTRACT

Methods and apparatuses for wearing state device operation are disclosed. In one example, a headset includes a sensor for detecting a headset donned state or a headset doffed state. The headset operation is modified based on whether the headset is donned or doffed.

13 Claims, 8 Drawing Sheets

WEARING STATE BASED DEVICE OPERATION

BACKGROUND OF THE INVENTION

The confluence of wireless communications, mobile computing devices, mobile phones, and the Internet have revolutionized the manner by which people can communicate. For example, not only can people receive voice calls on their mobile phones at any location and time, they can receive text based messages as well. These text based messages include electronic mail, text messages, and instant messages delivered over the Internet, cellular networks, and or wireless local area networks such as 802.11 networks.

Headsets have correspondingly increased in functionality as processing power has increased, and ubiquity as mobile communications and mobile devices have become ever present on people. However, with increased functionality due to increased processing power, headset battery power consumption may be significantly increased. Since the smaller form factor of headsets limits the physical size of headset batteries, power management in headsets is of paramount importance. For example, the headset standby time is important to users. Furthermore, with increased functionality, complexity of device operation increases and user interface issues associated with ease of use and efficiency arise.

As a result, improved methods and apparatuses for device operation are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
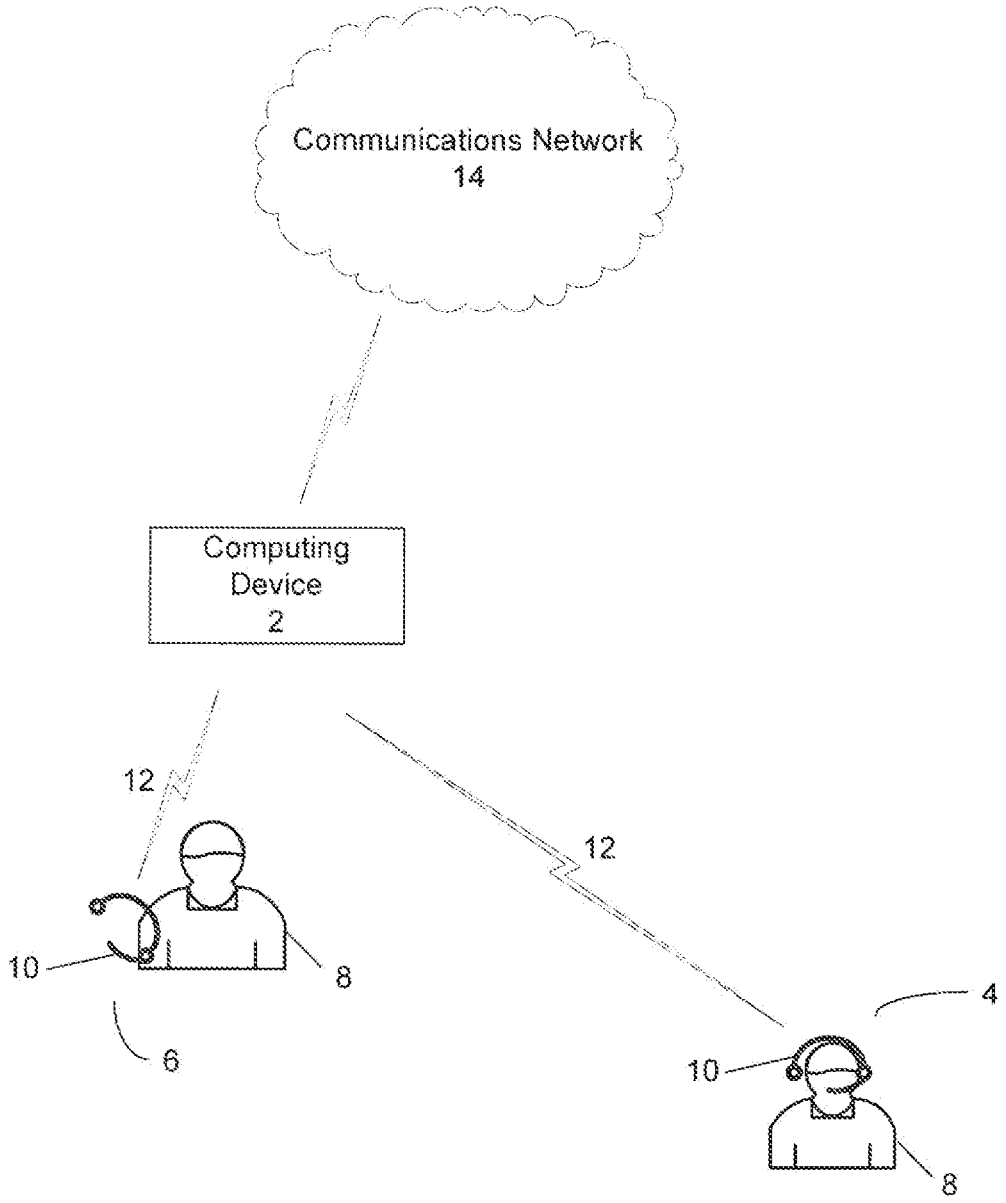
FIG. 1 illustrates a system for headset message notification in one example.

Methods and apparatuses for wearing state based device operation are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose, of clarity, details relating to technical material that is known in the technical fields related to the invention have not been described in detail so as not to unnecessarily obscure the present invention.

In one example, the determined wearing state of a device such as a headset is used to enable and disable functions in the device. For example, when the headset is not being worn on the user ear (referred to herein as a headset "doffed" state), a headset text-to-speech engine is turned off since the user is unlikely to hear the text-to-speech messages. Otherwise, the user would perceive reduced standby times of the headset due to unnecessary power consumption by the text-to-speech engine if messages are played back but not heard. In one example, if the headset has a speakerphone function, the text-to-speech messages can be routed to the speakerphone in the doffed state and to the in-ear speaker when the headset is being worn on the user ear (referred to herein as a headset "donned" state) if the user so chooses.

If the device has turned off text-to-speech messages in the doffed state, on a doffed to donned event, those messages may be queued to be played, or a summary message could be played, e.g. "You have 5 new emails and 4 new text messages, do you want to listen to them now?" Furthermore, in the doffed state, a vibrate motor or other method to alert the user of an incoming call can be used.

In one example, the device decides, if it has been in the doffed state for an extended period of time (e.g., 48 hours), to turn itself off or enter a low power state or turn off the wireless link. Upon entering a donned state, the device could power on again or reconnect the wireless link. Advantageously, battery power, including standby time, of the headset is preserved.

In one example, a headset includes a wireless transceiver, a processor, a speaker, and a donned or doffed detector configured to identify a headset donned state or a headset doffed state. The headset includes a text-to-speech application including instructions which when executed by the processor cause the headset to convert a text based message to audio speech. The headset further includes a text based message notification application including instructions which when executed by the processor cause the headset to output message playback options at the speaker responsive to an identified headset donned state.

In one example, a method for text based message notification at a headset includes receiving a notification message from a computing device (e.g., a mobile device such as a smartphone or laptop, or a personal computer) of a new text based message. The method includes identifying a transition from a headset doffed state to a headset donned state, and outputting text based message playback options at a headset speaker responsive to an identified headset donned state. The method further includes receiving a user selection to hear a text based message, and converting the text based message to audio speech at the headset and outputting the audio speech at a headset speaker.

In one example, an electronic device such as a headset includes a wireless transceiver, a processor, an in-the-ear speaker, and a donned or doffed detector configured to identify an electronic device donned state or an electronic device doffed state. The electronic device includes a device operation application having instructions which when executed by the processor cause the electronic device to selectively enable or disable electronic device functionality responsive to identification of the electronic device donned state or the electronic device doffed state. For example, the device operation application is configured to disable outputting of an audio file or outputting of a text string convertible to audio by a text-to-speech application responsive to identification of an electronic device doffed state, where the audio file or text string is stored in an electronic device memory. The audio file may be a pre-recorded message, and may be in a raw or compressed format. The audio files or text strings may be output when the electronic device is donned and the electronic device receives an event notification such as an incoming call or heart rate event.

In one example, a method for headset operation includes detecting a headset donned state or a headset doffed state, and selectively enabling or disabling a headset component or functionality responsive to identification of the headset donned state or the headset doffed state.

In one example, a computer readable storage memory stores instructions that when executed by a computer cause the computer to perform a method for message notification at a headset. The method for text based message notification at a headset includes receiving a notification message from a computing device (e.g., a mobile device such as a smartphone or laptop, or a personal computer) of a new text based message. The method includes identifying a transition from a headset doffed state to a headset donned state, and outputting text based message playback options at a headset speaker responsive to an identified headset donned state. The method further includes receiving a user selection to hear a text based message, and converting the text based message to audio speech at the headset and outputting the audio speech at a headset speaker. In a further example, the audio speech is output at a second speaker which is connected to the headset via either a wired or wireless connection.

In one example, a computer readable storage memory stores instructions that when executed by a computer cause the computer to perform a method for headset operation. The method includes receiving an indication of a headset donned state or a headset doffed state, and selectively enabling or disabling a headset component or functionality responsive to indication of the headset donned state or the headset doffed state.

In one example, an electronic device includes a wireless transceiver, a processor, a speaker, and a donned or doffed detector. The electronic device includes a device manager having instructions which when executed by the processor cause the electronic device to selectively conserve power responsive to identification of the electronic device donned state (i.e., being worn) or the electronic device doffed state (i.e., not being worn). For example, the device manager may initiate a low power mode for select components, powers off select components, or put the entire electronic device in a sleep mode when the electronic device is doffed. In low power or sleep mode, the ability to detect a transition from doffed state to donned state is maintained. Once a transition from doffed state to donned state is detected, the electronic device resumes full power operation.

In one example, an electronic device includes a wireless transceiver, a processor, a speaker, and a donned or doffed detector. In one example, the device is a headset. The headset includes a device manager having instructions which when executed by the processor cause the headset to selectively conserve power responsive to identification of the headset donned state or the headset doffed state. For example, the device manager may initiate a low power mode for select components, powers off select components, or put the entire headset in a sleep mode when the headset is doffed. In low power or sleep mode, the ability to detect a transition from doffed state to donned state is maintained. Once a transition from doffed state to donned state is detected, the headset resumes full power operation.

FIG. 1 illustrates a system for headset message notification in one example. The system includes a wireless headset 10 and a computing device 2. Wireless headset 10 and computing device 2 are capable of wireless communications therebetween over a wireless communication link 12. As illustrated in FIG. 1, a user 8 may be either wearing wireless headset 10 in a donned position 4 or the headset may be in a doffed position 6. For example, when the headset 10 is in a doffed position 6, it may be carried by user 8. As illustrated in FIG. 1, user 8 may be located at a varying proximity from computing device 2. Computing device 2 may, for example, be a smartphone (e.g., a cellular mobile phone), laptop computer, or desktop computer.

Computing device 2 is connected to a communications network 14. Communications network 14 may, for example, be the Internet, the Public Switched. Telephone Network, a cellular communications network, a local area network, or combination thereof. In one example, computing device 2 is connected to communications network 14 via a wireless communications link. In a further example, computing device 2 is connected to communications network 14 via a wired link. In a further example, computing device 2 is connected to headset 10 via a wired link.

Computing device 2 is any computing device operable as a text based message server. Computing device 2 may be an event generator which causes headset 10 to generate an audible message from stored audio data or a text string stored at the headset memory. Computing device 2 is operable to handle incoming messages from a remote network such as a cellular network or the Internet and send them to a message client, such as headset 10. The incoming messages may be stored at the computing device 2 prior to transfer to the message client.

In one example, the wireless communications network 14 is a cellular communications network which includes a server, such as an electronic mail (email) server for receiving text based messages for the user of the computing device 2 (e.g., a mobile wireless communications device).

Figure 2:
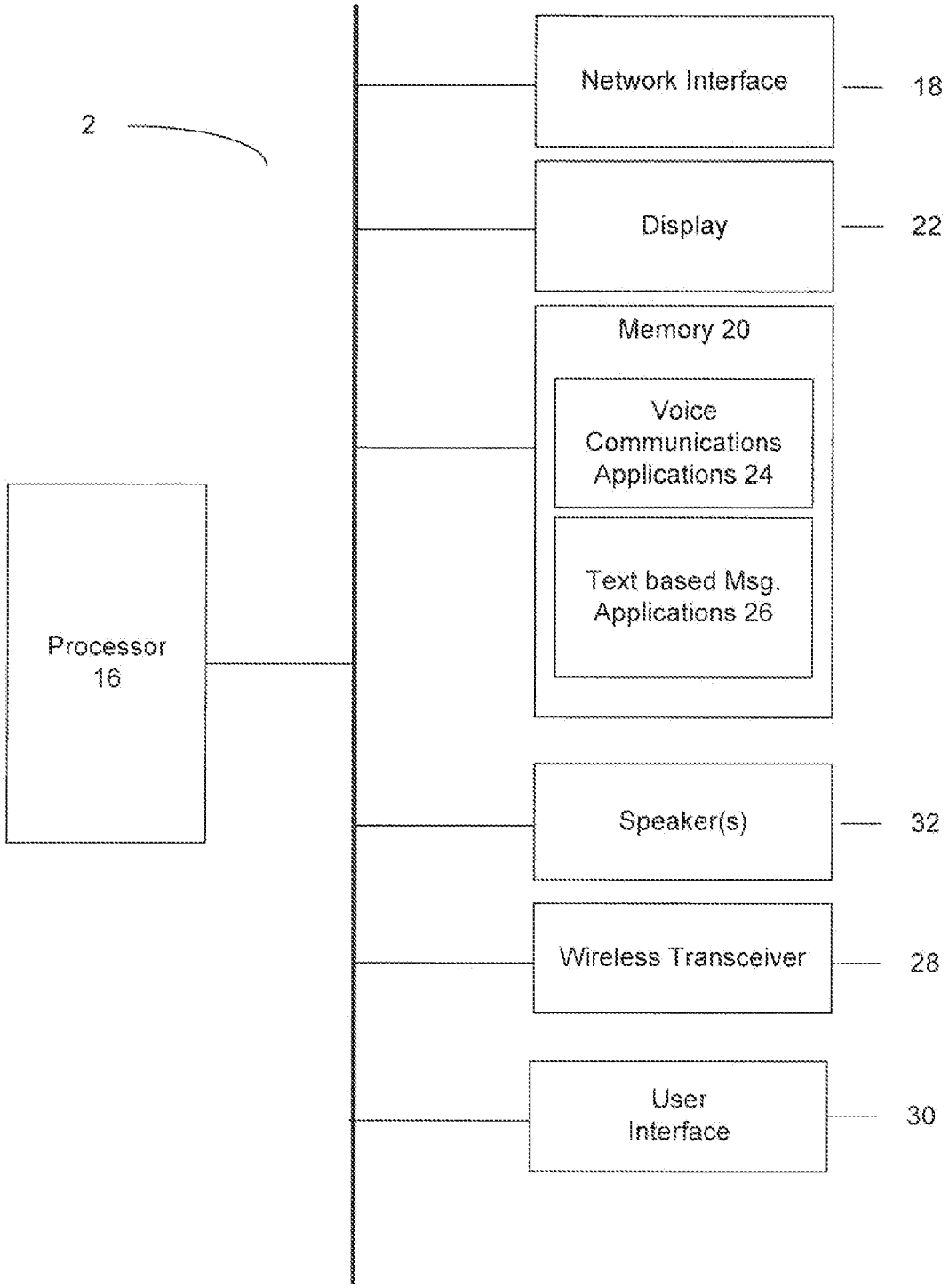
FIG. 2 illustrates a simplified block diagram of the computing device shown in FIG. 1.

The wireless communications network 14 may further include the appropriate switching and control circuitry for routing telephone calls to and from the computing device 2. In operation, the server receives text based messages (e.g., email messages) for delivery to the computing device 2 via the Internet, for example, as will be appreciated by those skilled in the art. The server then operates to send the text based messages to the computing device 2. The computing device 2 operates to receive the text based messages from the wireless communications network 14 using network interface 18. Referring to FIG. 2, the computing device 2 may then cause a computing device display 22 to display an indication that new text based messages have arrived, and/or display the messages themselves. In the case of a cellular network, the wireless transceiver 28 of the computing device 2 will correspondingly be a cellular transceiver. Any of various cellular formats and or protocols may be used.

FIG. 2 illustrates a simplified block diagram of the computing device shown in FIG. 1 in one example. Computing device 2 includes a processor 16 operably coupled to a network interface 18, a wireless transceiver 28 operable to communicate with a headset wireless transceiver, speakers 32, a display 22, a memory 20, and a user interface 30.

Memory 20 stores one or more voice communication applications 24 having instructions which when executed by the processor 16 cause the computing device 2 to receive an incoming call on the network interface 18. In one example, voice communications application 24 is a VoIP softphone application. In a further example, voice communications application 24 is a voice application typically running on a mobile cellular phone. In a further example, voice communications application 24 is a UCC application including voice, IM and other notification abilities, these abilities including but not restricted to call state and presence.

The memory 20 further includes one or more text based message applications 26 having instructions which when executed by the processor 16 cause the computing device 2 to receive or send a text based message. For example, the text based message application 26 may be configured to receive and transmit text based messages over a cellular network, instant messages over the Internet, or any type of electronic mail. Memory 20 may store incoming and outgoing messages. Although illustrated separately in FIG. 2, in further examples voice communications application 24 and text based message application 26 may be integrated into a single application.

In one example, the network interface 18 is a wireless transceiver and accompanying antenna for communications with a wireless router or access point. For example, the network interface 18 can be a Bluetooth or 802.11 transceiver. In a further example, network interface 18 is a wired interface, such as that an Ethernet jack used to connect to the Internet or a local area network. In one example, wireless transceiver 28 is a Bluetooth or 802.11 transceiver capable of wireless communication with a corresponding wireless transceiver at the wireless headset 10.

Processor 16 allows for processing data, including managing text based messages and receiving incoming calls over network interface 18. Processor 16 may include a variety of processors (e.g., digital signal processors), and may be a conventional CPU. Memory 20 may include a variety of memories, and in one example may include RAM, ROM, flash memory, a hard drive, an optical drive, or a combination thereof. Memory 20 may further include separate memory structures or a single integrated memory structure.

Figure 3:
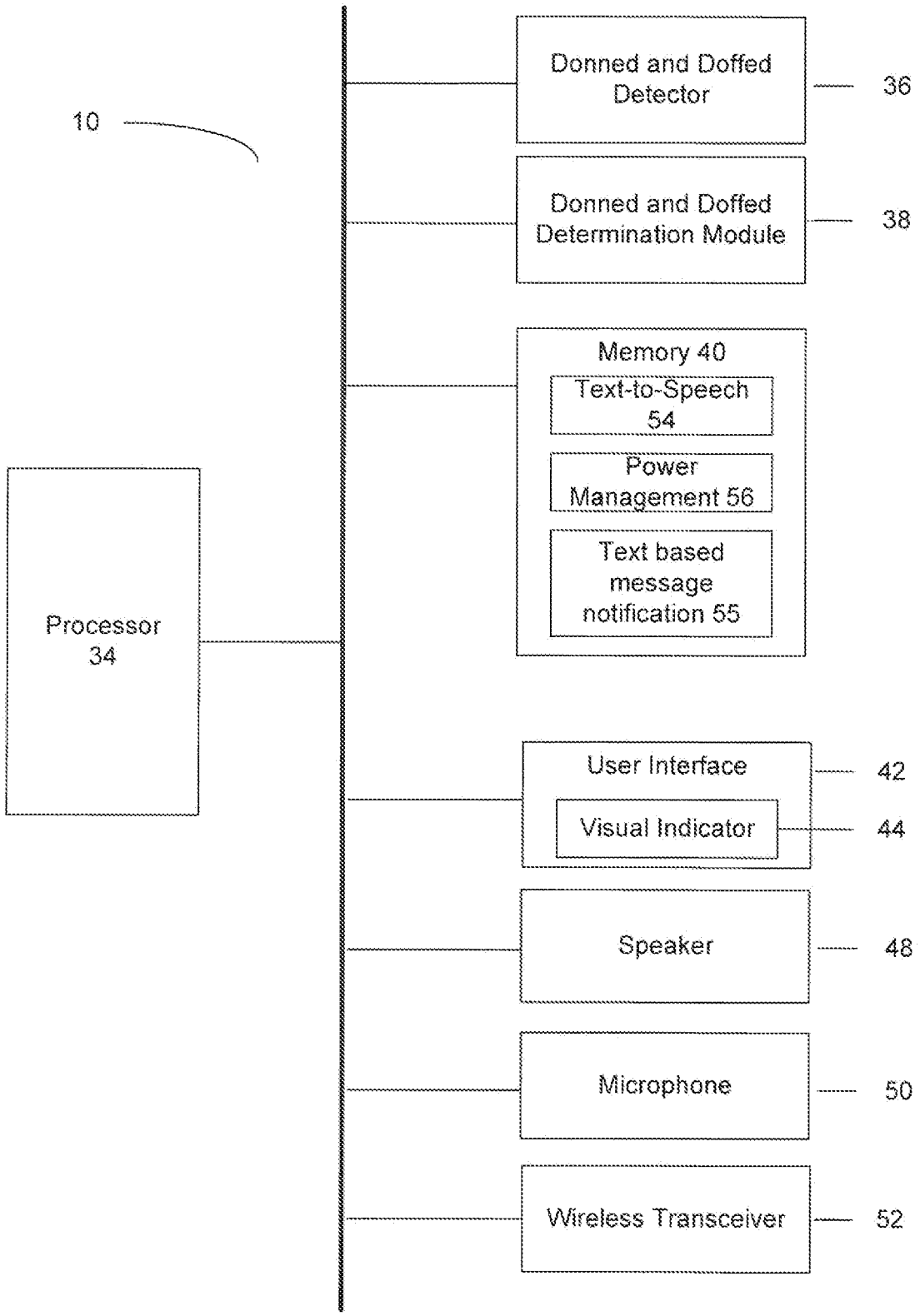
FIG. 3 illustrates a simplified block diagram of the headset shown in FIG. 1.

FIG. 3 illustrates a simplified block diagram of the headset shown in FIG. 1. Wireless headset 10 includes a donned and doffed detector 36. The wireless headset 10 includes a processor 34 operably coupled to the donned or doffed detector 36, a donned and doffed determination module 38, a memory 40, a user interface 42, a speaker 48, a microphone 50, and a wireless transceiver 52. Wireless transceiver 52 may, for example, be a Bluetooth transceiver to send and receive signals with external devices such as computing device 2.

Generally, wireless headset 10 may include a microphone 50 for communicating with other users and entering voice commands, and a speaker 48 to enable the user to listen to other subscribers, text menus of commands that are generated to speech, and text based messages that are converted to speech. Memory 40 may store a profile of the headset capabilities. Wireless headset 10 may also include an audio generator and automatic speech recognition capabilities. Microphone 50 allows a subscriber to speak into headset 10 and thereby communicate voice commands which are interpreted by the speech recognition module installed at the headset or computing device 2.

In one example, the headset 10 includes a text-to-speech application 54 including instructions which when executed by the processor cause the headset 10 to convert a text based message to audio speech. The headset 10 further includes a text based message notification application 55 including instructions which when executed by the processor cause the headset 10 to output message playback options at the speaker responsive to an identified headset donned state.

User interface 42 includes interfaces to receive input from the user and interfaces to output information to the user. For example, the headset output user interface may include a visual indicator 44. In a further example, the headset output user interface includes a vibrate ring indicator. In one example, the visual indicator 44 is a LCD display device or LED device. In one example, the vibrate indicator is a vibrate motor integrated with the wireless headset. The headset output user interface may also be an interface adapted to signal a vibrate motor coupled to the headset.

There are various types of sensors and detectors which can be employed as donned and doffed detector 36 to determine whether the headset 10 is donned or doffed. Techniques that can be used to determine whether the headset is donned or doffed include, but are not limited to, utilizing one or more of the following sensors and detectors integrated in the headset 10 and/or disposed on or within one or more of the headphones of the headset 10: a thermal or infrared sensor, skin resistivity sensor, capacitive touch sensor, inductive proximity sensor, magnetic sensor, piezoelectric-based sensor, and motion detector. Further details regarding these sensors and detectors can be found in the commonly assigned and copending U.S. patent application entitled "Donned and Doffed Headset State Detection", application Ser. No. 11/542,385, which was filed on Oct. 2, 2006, and which is hereby incorporated into this disclosure by reference for all purposes.

The output of donned and doffed detector 36 is provided to donned and doffed determination module 38 for determining whether the output of donned and doffed detector 36 corresponds to a donned state or a doffed state. Although illustrated separately, donned and doffed determination module 38 may be an application residing in memory 40.

Processor 34 allows for processing data, including managing donned and doffed data from donned and doffed detector 36, and receiving text based messages and incoming call notifications over wireless transceiver 52. Processor 34 may include a variety of processors (e.g., digital signal processors), and may be a conventional CPU. Memory 40 may include a variety of memories, and in one example includes RAM, ROM, flash memory, or a combination thereof. Memory 40 may include separate memory structures or a single integrated memory structure.

Referring to FIGS. 1-3, in one example operation, an incoming text based message is received at a text based message application 26 executing at computing device 2. In one example, the text based message includes an electronic mail message, a text message, or an instant message. The headset 10 receives notification of the new text based message. A headset donned state or a headset doffed state for wireless headset 10 is determined. Based upon the determined donned or doffed state of wireless headset 10, the text based message is either stored in memory (either at computing device 2 or headset 10) for later output or converted to an audio message and output to the user at the headset speaker 48. In one example, the text-to-speech application 54 is disabled when the headset 10 is in the headset doffed state.

In one example, the text based message notification application 55 outputs a new message summary responsive to transition from a headset doffed state to a headset donned state. In one example, the text based message notification application 55 retrieves new text based messages from a computing device (e.g., a mobile device such as a smartphone or laptop, or a personal computer) upon receiving a user request to play back a new text based message. In one example, the text based message notification application 55 retrieves new text based messages from a headset 10 memory for conversion and audio playback, the new text based messages stored in memory prior to the headset transitioning from a headset doffed state to a headset donned state.

In a further example, the headset 10 includes a device manager executing a device operation application including instructions which when executed by the processor 34 cause the headset 10 to selectively enable or disable headset 10 functionality responsive to identification of the headset donned state or the headset doffed state. In one example, the device operation application is configured to disable a headset 10 text-to-speech application responsive to identification of a headset doffed state.

In one example, the headset 10 includes a loudspeaker operable as a speakerphone, where the device operation application routes playback of audible speech associated with a text based message to the in-the-ear speaker when the headset 10 is in a donned state and routes playback of audible speech associated with a text based message to the loudspeaker when the headset 10 is in a doffed state. In one embodiment, the in-the-ear speaker and the loudspeaker are separate transducers. In a further embodiment, a single transducer that is operable as both an in-the-air speaker and a loudspeaker is utilized. In one example, the headset 10 further includes a vibrate motor configured to alert a user of an incoming new text based message or an incoming voice call, wherein the device operation application routes alerts to the vibrate motor when the headset 10 is in a doffed state.

In one example, a headset 10 includes a wireless transceiver, a processor 34, a speaker, and a donned or doffed detector. The headset 10 includes a device manager having instructions which when executed by the processor 34 cause the headset 10 to selectively conserve power responsive to identification of the headset donned state or the headset doffed state. For example, the device manager may utilize a power management module 56 to initiate a low power mode for select components, powers off select components, or put the entire headset 10 in a sleep mode when the headset 10 is doffed. In low power or sleep mode, the ability to detect a transition from doffed state to donned state is maintained. Once a transition from doffed state to donned state is detected, the headset 10 resumes increased or full power operation.

Text-to-speech converter 54 is operable to convert a text-based message to a speech-based signal and the headset 10 is adapted to generate audible or acoustic signals for the headset user. In one example, the text-formatted messages are real time messages, such as an Instant Message, which are converted to speech-formatted messages.

In one implementation, the text-to-speech converter 54 includes a text-to-speech engine that controls the text-to-speech translation, acoustic files containing the sounds for pronouncing the words of text, text-to-speech databases that define the correspondence of text-to-speech, and a memory in which a received text message for translation is stored. Various approaches may also be used for converting the selected text based messages to audio messages. By way of example, the text-to-speech converter 54 may be a software module that is run by the headset processor when needed. Various text-to-speech conversion modules, which are known to those skilled in the art, may be used in accordance with the present invention.

Figure 4:
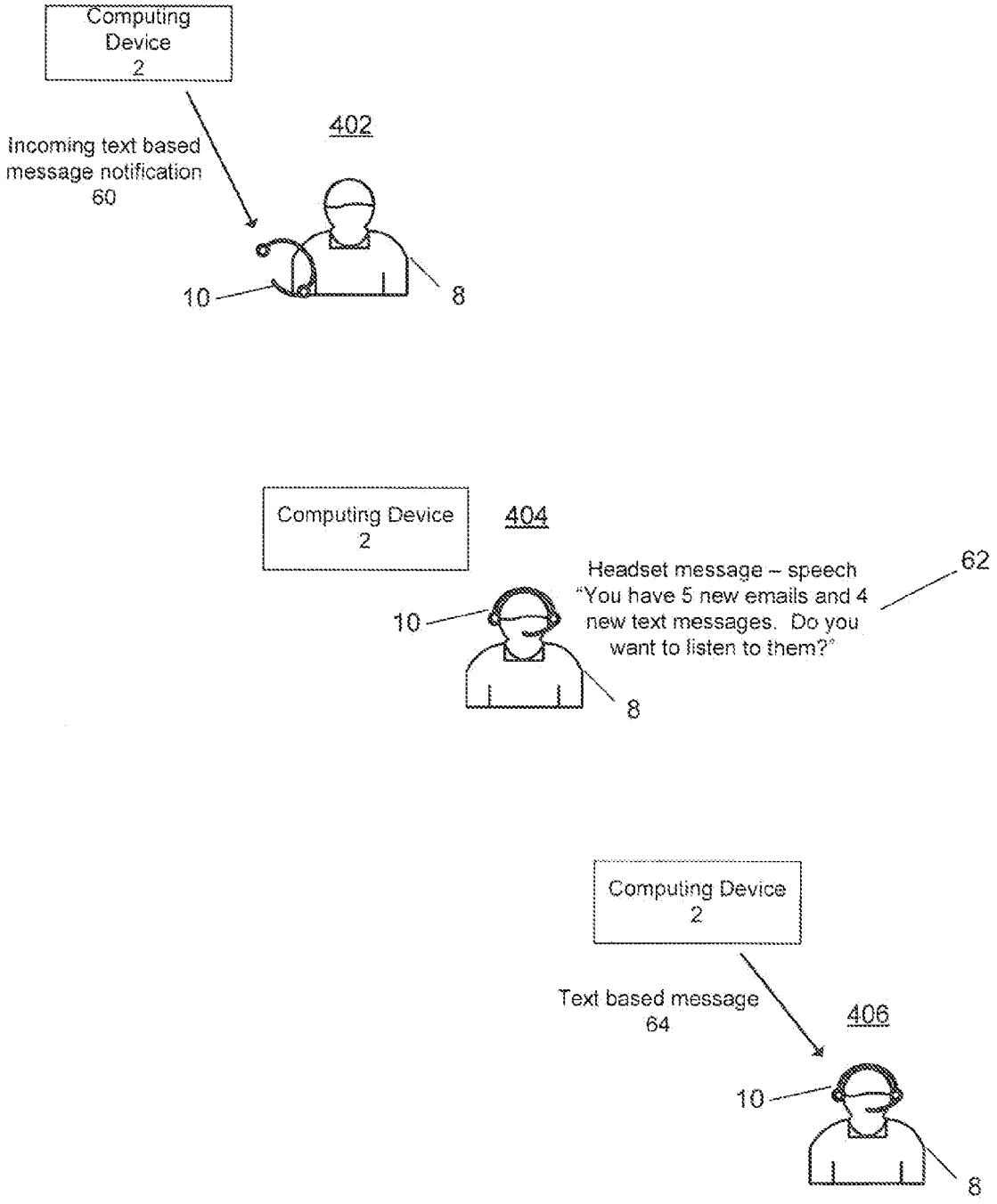
FIG. 4 illustrates incoming text based message handling in one example operation.

FIG. 4 illustrates incoming text based message handling in one example operation. In a usage state 402, computing device 2 receives a text based message over a communications network. Computing device 2 sends an incoming text based message notification 60 the headset 10. Upon receiving the text based message notification 60, headset 10 identifies whether it is in a donned state or a doffed state. In usage state 402, a user 8 has headset 10 in a doffed state. In one example, in usage state 402 where the headset is doffed, upon receiving the incoming text based message notification 60, the headset 10 outputs a visual and/or vibrate incoming text notification to user 8. This may operate to instruct the user 8 to transition the headset 10 to a donned state.

In usage state 404, the user 8 has transitioned the headset 10 from a doffed state to a donned state. Upon transition to the donned state, the headset outputs audible speech 62 to the user 8 summarizing message activity. For example, the audible speech 62 may inform the user 8 of the number of new emails and text messages. The user is then presented with audible menu options associated with message playback, including play, pause, save, delete, etc.

In usage state 406, the user 8 has selected to play back a text based message. In one example, headset 10 retrieves the selected text based message 64, converts it to audible speech, and outputs it to the wearer.

Figure 5:
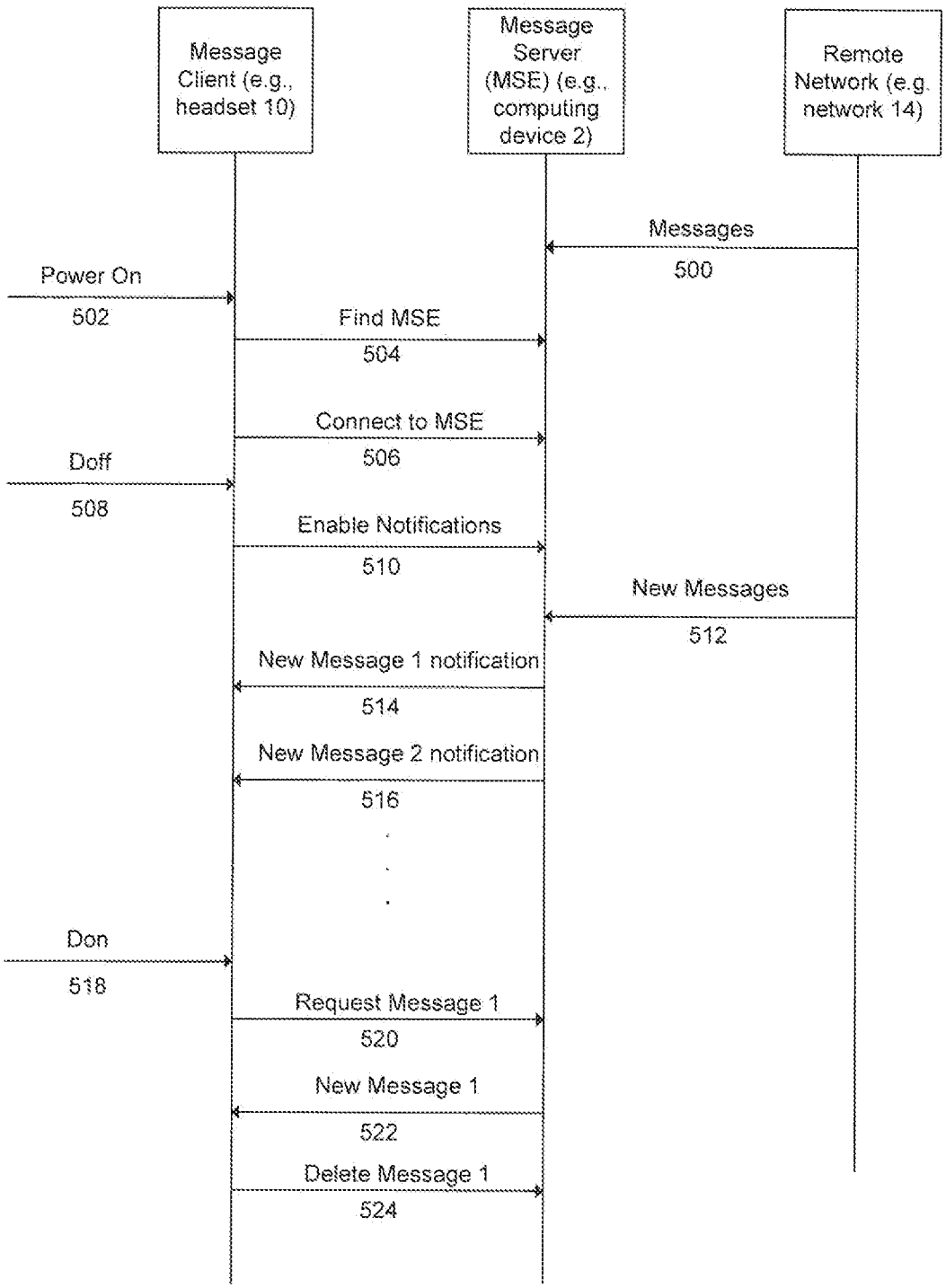
FIG. 5 illustrates a message flow diagram for command messages between system components in one example operation.

FIG. 5 illustrates a message flow diagram between system components in one example operation. In this example call flow, messages for a subscriber are received at a message server (e.g., computing device 2) over a remote network (e.g., communications network 14) (step 500). A message client (e.g., headset 10) is powered on by a user (step 502). The message client scans for and finds the message server (step 504) and connects to the message server (step 506). The message client detects a currently doffed state (step 508). The message client then enables message notifications to be received from message server (step 510). While in a doffed state, new message notifications may be received at the message server from the remote network (step 512).

A first new message notification message is sent to the message client (step 514), a second new message notification message is sent to the message client (step 516), etc., until all new message notification messages are sent. Message notifications may be sent over a Bluetooth or other wireless protocol link. The message client detects a currently donned state (step 518). The message client transmits a "request message" command to the message server (step 520). The first message (i.e., message payload) is sent by the message server to the message client (step 522). The message payload is processed using a text-to-speech converter and the audio is played to the user. The message client then transmits a "delete message" command to the message server commanding the message server to delete the first message from memory. Steps 520-524 are repeated for each text-based message received.

Figure 6A:
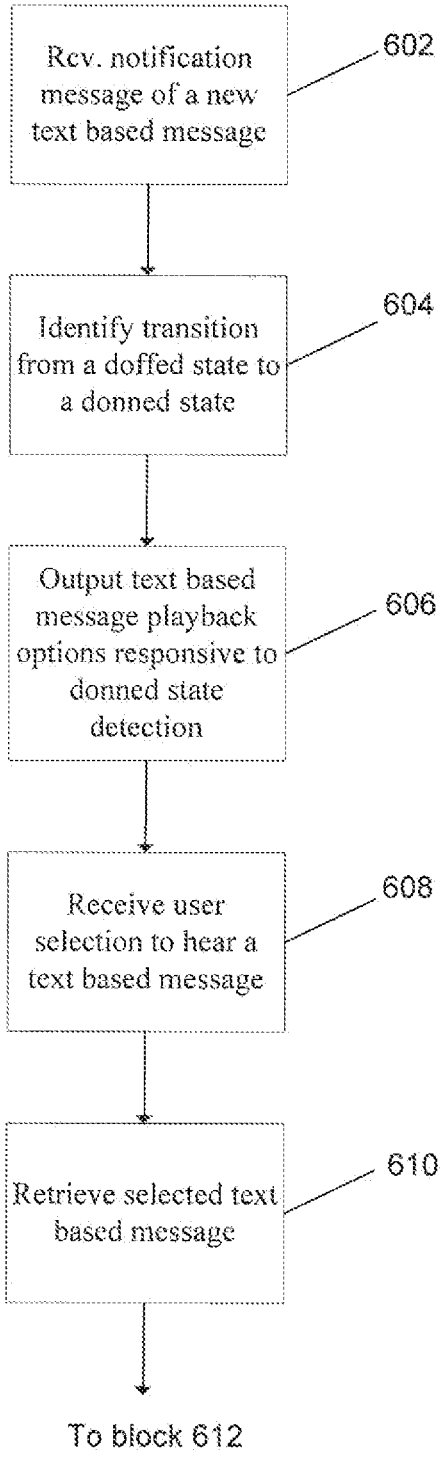
FIGS. 6A and 6B are a flow diagram illustrating retrieval, conversion, and playback of text based messages in one example.
Figure 6B:
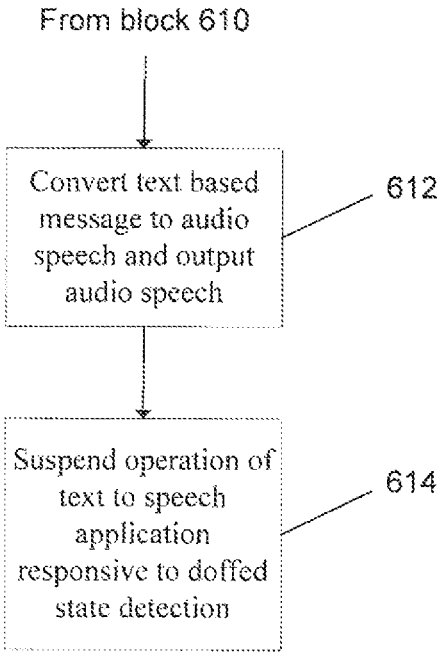

FIGS. 6A and 6B are a flow diagram illustrating retrieval, conversion, and playback of text based messages in one example. At block 602, notification of a new text based message is received. For example, a notification message is received at a headset from a computing device of a new text based message. At block 604, a transition from a headset doffed state to a headset donned state is identified. At block 606, text based message playback options are output at a headset speaker responsive to an identified headset donned state. In one example, responsive to identifying the transition from a headset doffed state to a headset donned state, a message summary is output at the headset speaker which includes the number of new messages.

At block 608, a user selection is received to hear a text based message. At block 610, the selected text based message is retrieved. In one example, the text based message is retrieved from the computing device. In a further example, the text based message is retrieved from a headset memory. At block 612, the retrieved text based message is converted to audible speech at the headset and output at a headset speaker. At block 614 a headset doffed state is detected and operation of a the text-to-speech converter is suspended responsive to identifying the transition from a headset donned state to a headset doffed state. In one example, during a headset doffed state, indications of new text based messages are output at the headset utilizing a headset vibrate motor or a headset speakerphone.

Figure 7:
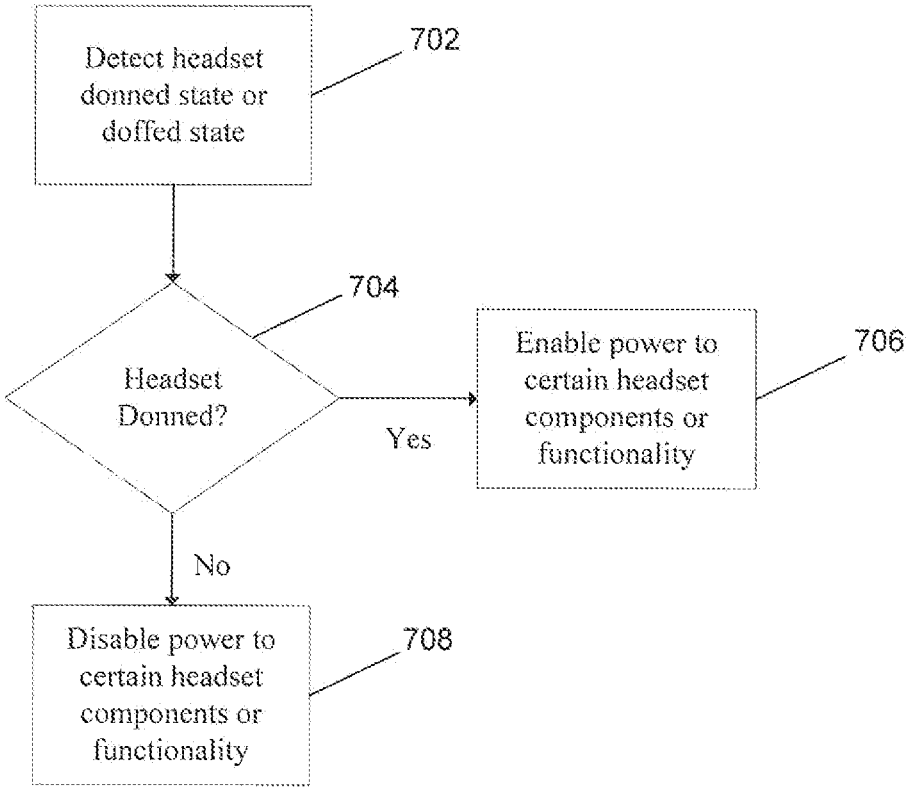
FIG. 7 is a flow diagram illustrating headset power management in one example.

FIG. 7 is a flow diagram illustrating headset power management in one example. At block 702, a headset donned state or a headset doffed state is detected. At decision block 704 it is determined if the headset is donned. If yes at decision block 704, power is enabled to certain components or functionality. If no at decision block 704, at block 708 power to certain headset components or functionality is disabled or reduced.

In one example, selectively enabling or disabling a headset component or functionality responsive to identification of the headset donned state or the headset doffed state includes disabling a text-to-speech application responsive to identification of a headset doffed state. In one example, selectively enabling or disabling a headset component or functionality responsive to identification of the headset donned state or the headset doffed state includes routing an incoming call or message alert to a headset speaker operating as a speakerphone responsive to identification of a headset doffed state.

In one example, selectively enabling or disabling a headset component or functionality responsive to identification of the headset donned state or the headset doffed state includes reducing power to or powering down a headset transceiver, display, or microphone responsive to identification of a headset doffed state. Upon detection of a donned state, the headset transceiver, display, or microphone is returned to a full power state.

While the exemplary embodiments of the present invention are described and illustrated herein, it will be appreciated that they are merely illustrative and that modifications can be made to these embodiments without departing from the spirit and scope of the invention. Thus, the scope of the invention is intended to be defined only in terms of the following claims as may be amended, with each claim being expressly incorporated into this Description of Specific Embodiments as an embodiment of the invention.

What is claimed is:

1. A headset comprising:

a wireless transceiver;

a processor;

a speaker;

a donned or doffed detector configured to identify a headset donned state or a headset doffed state, wherein the headset donned state is the headset worn on a user ear;

a text to speech application comprising instructions which when executed by the processor cause the headset to convert a text based message to audio speech; and a text based message notification application comprising instructions which when executed by the processor cause the headset to receive a notification message at the headset from a computing device of a text based message, identify a transition from a headset doffed state to a headset donned state subsequent to receiving the notification message at the headset from the computing device of the text based message, and output playback options regarding the text based message at the speaker responsive to the transition from the headset doffed state to the headset donned state.

2. The headset of claim 1, wherein the text based message notification application outputs a new message summary responsive to transition from a headset doffed state to a headset donned state.

3. The headset of claim 1, wherein the text based message comprises an electronic mail message, a text message, or an instant message.

4. The headset of claim 1, wherein the text based message notification application retrieves new text based messages from a headset memory for conversion and audio playback by the text-to-speech application, the new text based messages stored in memory prior to the headset transitioning from a headset doffed state to a headset donned state.

5. The headset of claim 1, wherein the text based message notification application retrieves new text based messages from a computing device upon receiving a user request to play back a new text based message.

6. The headset of claim 1, wherein the text-to-speech application is disabled when the headset is in the headset doffed state.

7. A method for text based message notification at a headset comprising:

receiving a notification message at a headset from a computing device of a text based message;

identifying a transition from a headset doffed state to a headset donned state subsequent to receiving the notification message at the headset from the computing device of the new text based message;

outputting playback options regarding the text based message at a headset speaker responsive to identifying the transition from the headset doffed state to the headset donned state;

receiving a user selection to hear the text based message; and converting the text based message to audio speech at the headset and outputting the audio speech at a headset speaker.

8. The method of claim 7, further comprising retrieving the text based message from a computing device following receiving a user selection to hear a text based message.

9. The method of claim 7, wherein further comprising retrieving the text based message from a headset memory following receiving a user selection to hear a text based message.

10. The method of claim 7, further comprising outputting a message summary at the headset speaker comprising a number of new messages responsive to identifying the transition from a headset doffed state to a headset donned state.

11. The method of claim 7, wherein the text based message comprises an electronic mail, text message, or instant message.

12. The method of claim 7, further comprising:

identifying a transition from a headset donned state to a headset doffed state; and suspending operation of a text-to-speech application responsive to identifying the transition from a headset donned state to a headset doffed state.

13. The method of claim 7, further comprising:

identifying a transition from a headset donned state to a headset doffed state; and outputting an indication of a new text based message utilizing a headset vibrate motor or a headset speakerphone while the headset is in the headset doffed state;

converting the new text based message to audio speech and outputting the audio speech at the headset speakerphone while the headset is in the headset doffed state subsequent to identifying the transition from the headset donned state to the headset doffed state.

* * * * *